US009234304B2

(12) United States Patent
Bruner

(10) Patent No.: US 9,234,304 B2
(45) Date of Patent: Jan. 12, 2016

(54) COMPOSITE ELASTOMERIC YARNS AND FABRIC

(71) Applicant: The Quantum Group, Inc., Colfax, NC (US)

(72) Inventor: Jeffrey W Bruner, Leasburg, NC (US)

(73) Assignee: The Quantum Group, Inc., Colfax, NC (US)

( * ) Notice: Subject to any disclaimer, the term of this patent is extended or adjusted under 35 U.S.C. 154(b) by 406 days.

(21) Appl. No.: 13/911,681

(22) Filed: Jun. 6, 2013

(65) Prior Publication Data

US 2013/0298520 A1 Nov. 14, 2013

Related U.S. Application Data

(63) Continuation of application No. 11/518,679, filed on Sep. 11, 2006, now Pat. No. 8,484,940, and a continuation of application No. 10/830,977, filed on Apr. 23, 2004, now abandoned, and a continuation of (Continued)

(51) Int. Cl.
*D02G 3/22* (2006.01)
*D02G 3/34* (2006.01)

(Continued)

(52) U.S. Cl.
CPC .. *D02G 3/32* (2013.01); *D02G 3/22* (2013.01); *D02G 3/328* (2013.01); *D02G 3/34* (2013.01);

(Continued)

(58) Field of Classification Search
CPC ..... D02G 3/32; D02G 3/22; D02G 3/402; D02G 3/34; D02G 3/36; D02G 3/408; D02G 3/42; D02G 3/38; D03D 27/02; D03D 15/00; D03D 15/0077; D04B 1/04; D04B 1/18; D04B 21/04; D04B 21/18; D04C 1/02; D04H 1/04
USPC ..... 57/203, 210, 225, 230, 234; 442/182, 442/184, 189, 190, 191, 200, 306, 308, 311, 442/324, 328, 334, 364
See application file for complete search history.

(56) References Cited

U.S. PATENT DOCUMENTS 1,853,666 A 4/1932 Crimmins
1,963,813 A 6/1934 Voorhis (Continued)

FOREIGN PATENT DOCUMENTS

EP 0107283 B1 4/1988
EP 0339965 A1 11/1989

(Continued)

OTHER PUBLICATIONS

16 CFR § 303.7(k), Federal Trade Commission, Rules and Regulations under the Textile Fiber Products Identification Act, Generic names and definitions for manufactured fibers. [24 FR 4480, Jun. 2, 1959; 24 FR 5737, Jul. 17, 1959], http://ecfr.gpoaccess.gov/cgi/t/text/text-idx?c=ecfr&sid=657af24bd232c4c279f9486a042df77d&rgn=div5&view=text&node=16:1.0.1.3.27&idno=16, 1 page.

(Continued)

*Primary Examiner* — Cheryl Juska
(74) *Attorney, Agent, or Firm* — Smith Moore Leatherwood LLP; John P. Zimmer

(57) ABSTRACT

The present invention relates to composite elastomeric yarns and fabrics, to methods of making same, and to articles in which such yarns and fabrics are used. The composite yarns of the present invention comprise a elastomeric core, an elastomeric thermoplastic sheath disposed about the core and, preferably, fibers mechanically anchored in the sheath. The composite fabrics of the present invention comprise the composite yarns of the present invention and conventional fibers arranged to form a fabric.

9 Claims, 9 Drawing Sheets

Related U.S. Application Data application No. 09/253,810, filed on Feb. 19, 1999, now abandoned, and a continuation-in-part of application No. 08/775,610, filed on Dec. 31, 1996, now abandoned.

(51) Int. Cl.

| | |
|---|---|
| ***D02G 3/32*** | (2006.01) |
| ***D04B 21/18*** | (2006.01) |
| ***D04B 1/18*** | (2006.01) |
| ***D04B 1/04*** | (2006.01) |
| ***D04B 21/02*** | (2006.01) |
| ***D02G 3/36*** | (2006.01) |
| ***D02G 3/40*** | (2006.01) |
| ***D03D 27/02*** | (2006.01) |
| ***D03D 27/10*** | (2006.01) |
| ***D06C 7/00*** | (2006.01) |
| ***D02G 3/38*** | (2006.01) |

(52) U.S. Cl.

CPC .. *D02G 3/36* (2013.01); *D02G 3/38* (2013.01); *D02G 3/408* (2013.01); *D03D 27/02* (2013.01); *D03D 27/10* (2013.01); *D04B 1/04* (2013.01); *D04B 1/18* (2013.01); *D04B 21/02* (2013.01); *D04B 21/18* (2013.01); *D06C 7/00* (2013.01); *Y10T 428/23957* (2015.04); *Y10T 428/23964* (2015.04); *Y10T 428/23979* (2015.04); *Y10T 428/23986* (2015.04)

(56) References Cited

U.S. PATENT DOCUMENTS

| | | | | | |
|---|---|---|---|---|---|
| 2,031,375 | A | | 2/1936 | Lilley | |
| 2,076,273 | A | | 4/1937 | Harris | |
| 2,096,816 | A | | 10/1937 | Lilley | |
| 2,146,966 | A | * | 2/1939 | Lilley | D02G 3/328 525/332.7 |
| 2,247,308 | A | | 6/1941 | Redman | |
| 2,262,017 | A | | 11/1941 | Lilley | |
| 2,733,179 | A | | 1/1956 | Smith | |
| 3,011,302 | A | | 12/1961 | Rupprecht | |
| 3,285,797 | A | | 11/1966 | Harrison et al. | |
| 3,382,662 | A | * | 5/1968 | Seelig | D02G 3/328 427/171 |
| 3,583,890 | A | | 6/1971 | Kolckmann | |
| 3,621,646 | A | * | 11/1971 | Bobkowicz | D01D 5/00 57/224 |
| 3,968,283 | A | | 7/1976 | Schutte | |
| 4,136,715 | A | | 1/1979 | McCormack et al. | |
| 4,425,465 | A | | 1/1984 | Padget et al. | |
| 4,469,738 | A | | 9/1984 | Himelreich, Jr. | |
| 4,469,739 | A | | 9/1984 | Gretzinger et al. | |
| 4,483,900 | A | | 11/1984 | Goldfarb | |
| 4,493,917 | A | | 1/1985 | Bailleux et al. | |
| 4,545,614 | A | | 10/1985 | Abu-Isa et al. | |
| 4,668,552 | A | | 5/1987 | Scott | |
| 4,668,553 | A | | 5/1987 | Scott et al. | |
| 4,724,664 | A | | 2/1988 | Goerens | |
| 4,801,503 | A | | 1/1989 | Jennings | |
| 4,869,554 | A | | 9/1989 | Abu-Isa et al. | |
| 4,886,693 | A | | 12/1989 | Haranoya et al. | |
| 5,009,955 | A | | 4/1991 | Abu-Isa | |
| 5,013,089 | A | | 5/1991 | Abu-Isa et al. | |
| 5,069,957 | A | | 12/1991 | Vandermeersch | |
| 5,082,711 | A | | 1/1992 | Goerens | |
| 5,106,678 | A | | 4/1992 | Abu-Isa | |
| 5,246,265 | A | | 9/1993 | Nagan et al. | |
| 5,387,383 | A | | 2/1995 | Collier et al. | |
| 5,414,984 | A | * | 5/1995 | Groshens | D02G 3/40 57/224 |
| 5,417,046 | A | | 5/1995 | Setzer | |
| 5,425,796 | A | | 6/1995 | Loubinoux et al. | |
| 5,457,968 | A | | 10/1995 | McClintock et al. | |
| 5,458,972 | A | | 10/1995 | Hagen | |
| 5,468,555 | A | | 11/1995 | Lijten et al. | |
| 5,481,861 | A | | 1/1996 | Frith | |
| 5,505,889 | A | | 4/1996 | Davies | |
| 5,533,789 | A | | 7/1996 | Waldrop et al. | |
| 5,536,551 | A | | 7/1996 | Woosley | |
| 5,555,716 | A | | 9/1996 | Dugan | |
| 5,560,192 | A | | 10/1996 | Frith | |
| 5,618,624 | A | | 4/1997 | Dinger et al. | |
| 5,632,526 | A | | 5/1997 | Waldrop et al. | |
| 5,654,067 | A | | 8/1997 | Dinger et al. | |
| 5,807,794 | A | | 9/1998 | Waldrop et al. | |
| 5,855,991 | A | | 1/1999 | McLarty, III | |
| 5,856,249 | A | | 1/1999 | Waldrop et al. | |
| 6,035,901 | A | | 3/2000 | Stumpf et al. | |
| 6,062,014 | A | * | 5/2000 | Yeh | A63B 51/02 57/232 |
| 6,460,321 | B1 | * | 10/2002 | Koshimae | A63B 51/02 57/210 |
| 6,557,590 | B2 | | 5/2003 | Swers et al. | |
| 7,134,265 | B2 | | 11/2006 | Shigemura | |
| 7,201,024 | B2 | | 4/2007 | Hirayama et al. | |
| 8,484,940 | B2 | | 7/2013 | Bruner | |
| 2001/0009833 | A1 | | 7/2001 | Waldrop et al. | |
| 2001/0038912 | A1 | | 11/2001 | Billarant et al. | |
| 2002/0088501 | A1 | | 7/2002 | Bruner | |
| 2003/0005997 | A1 | | 1/2003 | Bruner | |
| 2003/0039833 | A1 | | 2/2003 | Sen et al. | |
| 2004/0137226 | A1 | | 7/2004 | Bruner | |
| 2005/0042412 | A1 | | 2/2005 | Bruner | |
| 2005/0245686 | A1 | | 11/2005 | Stevens et al. | |
| 2006/0113033 | A1 | | 6/2006 | Bruner | |
| 2006/0216506 | A1 | | 9/2006 | Xiang et al. | |
| 2007/0087158 | A1 | | 4/2007 | Bruner | |
| 2008/0040906 | A1 | | 2/2008 | Earley et al. | |
| 2009/0305037 | A1 | | 12/2009 | Tsukada et al. | |
| 2012/0036899 | A1 | | 2/2012 | Seno et al. | |

FOREIGN PATENT DOCUMENTS

| | | | | | |
|---|---|---|---|---|---|
| EP | 0400838 | A2 | | 12/1990 | |
| EP | 446377 | A1 | | 9/1991 | |
| EP | 0645976 | A1 | | 4/1995 | |
| EP | 0648873 | A1 | | 4/1995 | |
| EP | 0728680 | A1 | | 8/1996 | |
| EP | 0728860 | A1 | | 8/1996 | |
| FR | 2272204 | A1 | | 12/1975 | |
| FR | WO 9522644 | A1 | * | 8/1995 | D01H 4/00 |
| GB | 418118 | A | * | 10/1934 | D02G 3/32 |
| GB | 731381 | A | * | 6/1955 | D02G 3/402 |
| GB | 1238383 | A | * | 7/1971 | D02G 3/408 |
| GB | 2138038 | A | * | 10/1984 | D02G 3/408 |
| GB | 1053390 | A1 | | 11/2000 | |
| JP | 48100950 | A | | 11/1973 | |
| JP | 50152050 | A | | 12/1975 | |
| JP | 59030937 | | | 2/1984 | |
| JP | 61031242 | A | | 2/1986 | |
| JP | 10298840 | A | | 11/1988 | |
| JP | 06017350 | A | | 1/1994 | |
| JP | 06002240 | A | | 11/1994 | |
| JP | 08100354 | A | | 4/1996 | |
| JP | 09258739 | A | | 10/1997 | |
| JP | 11217746 | A | | 8/1999 | |
| JP | 01280038 | A | | 10/2001 | |
| JP | 2003293234 | A | | 10/2003 | |
| JP | 4124823 | B2 | | 7/2008 | |
| JP | 2009235618 | A | | 10/2009 | |
| JP | 2010222720 | A | | 10/2010 | |
| WO | 9325121 | A1 | | 12/1993 | |
| WO | 9502721 | A1 | | 1/1995 | |
| WO | 9829587 | A1 | | 7/1998 | |
| WO | 9839503 | A1 | | 9/1998 | |
| WO | 9942644 | A1 | | 8/1999 | |

OTHER PUBLICATIONS

Chart—Denier v. Diameter for HYTREL's 4056, 4074, 5556, and 5544, copyright date unknown, 1 page.

(56) References Cited

OTHER PUBLICATIONS

Dymetrol Seating Support Systems Product Manual, DuPont, copyright 1996, 23 pages.
Dymetrol Seating Supports for Automotive Application, James Gretzenger, Ph.D., copyright date unknown, 9 pages.
Expansion for Elastane Yarns, Man-Made Fiber Year Book, copyright 1996, p. 28, 1 page.
HYTREL Design Guide—Module V (grades 4056, 5556, 6356, 7246), copyright 1995, 72 pages.
HYTREL Product and Properties Guide (grades 4056, 5556, 6356, 7246), copyright date unknown, 13 pages.
"Polyurethane," Engineer's Handbook, Engineering Materials, web page, copyright 2004-2006, http://www.engineershandbook.com/Materials/polyurethane.htm, EngineersHandbook.com, 1 page.
"Thermoset Plastics," Engineer's Handbook, Engineering Materials, web page, copyright 2004-2006, http://www.engineershandbook.com/Materials/thermoset.htm, 1 page.
Woven Pile Fabrics in the Automtive Industry, presented by Gilbert Moulin, Michael Van De Wiele NV Textile Machinery for Automotive Textiles—Information, Trends and Opportunities, copyright Apr. 1986, New York, NY, 29 pages.

* cited by examiner

COMPOSITE ELASTOMERIC YARNS AND FABRIC

RELATED APPLICATIONS

This application is a continuation of application Ser. No. 11/518,679 filed Sep. 11, 2006, which is a continuation of application Ser. No. 10/830,977 filed Apr. 23, 2004, which is a continuation of application Ser. No. 09/253,810 filed Feb. 19, 1999, which claims the benefit of U.S. Provisional Application Ser. No. 60/075,439 filed Feb. 20, 1998, and is a continuation-in-part of application Ser. No. 08/775,610, filed Dec. 31, 1996.

FIELD OF THE INVENTION

This invention relates to certain composite elastomeric yarns and fabrics suitable for use in furniture/seating fabrics, methods for making said composite elastomeric yarns and fabrics, and articles incorporating fabrics comprising said composite elastomeric yarns. The composite elastomeric yarns and fabrics of the present invention are particularly well suited for use in indoor and outdoor furniture fabrics for seats, both bottoms and backs, installed in various forms of ground transportation such as automobiles, motorcycles, trucks, buses, trains, etc., as well as various aircraft and marine craft, where a lightweight combination of strength, comfort and style is desired.

BACKGROUND OF THE INVENTION

In the past, elastomeric yarns used to produce fabrics having elastomeric properties have typically included rubber and elastomeric polyurethanes, such as spandex, which possess high coefficients of friction. As a result, they are difficult to handle in typical textile yarn and fabric manufacturing processes and are uncomfortable when in direct contact with the human body. Accordingly, it has been necessary to cover, coat or in some other manner conceal the rubber or polyurethanes in the yarn or fabric structure to provide the desired aesthetic, design, comfort, wear and durability characteristics when used in most apparel, home furnishings, medical, automotive, air and marine craft applications, as well as other industrial fabric applications.

In automotive, air and marine craft applications, elastomeric yarns have been incorporated in fabrics used to cover vehicle seats. Vehicle seats found in the various forms of ground, air and marine transportation have often been constructed from varying combinations of bulky polyurethane stuffing material or molded foam cushioning which is then mounted on wire frames or stamped metal pans and covered with fabric. The fabric is typically cut and sewn to size to contain and protect the materials contained within the seat as well as provide a comfortable, durable and attractive finish suitable for the interior design scheme of the vehicle. Depending on the combination of materials chosen, springs or elastic straps are also often used in the seat to provide a vehicle seating assembly with greater static and dynamic support characteristics, as well as passenger comfort. In such seating assemblies, however, the extensive use of foam cushioning, stuffing material and springs or elastic straps adds significantly to the weight of the finished product which is undesired in vehicle applications where fuel economy is often a goal. Further, the use of varying combinations of these separate components results in seat assemblies having higher costs of materials and, because of complicated assembly procedures, greater labor costs as well.

While thin profile seats have been developed, they have not provided the aesthetic qualities that are desired in many furniture fabrics. An example of such thin profile seats is found in Stumpf, et al. (PCT Application No. PCT/US93/05731), which is incorporated herein by reference, wherein an office chair is disclosed.

It is therefore an object of the present invention to provide a composite yarn having elastomeric characteristics.

It is another object of the present invention to provide a composite elastomeric yarn suitable for use in fabrics which offers support and comfort while allowing for significant reduction in the need for foam materials, springs or elastic straps.

It is still another object of the present invention to provide a composite elastomeric yarn which can accommodate a wide variety of surface textures and fiber densities.

It is yet another object of the present invention to provide a method of forming composite elastomeric yarns which are suitable for use in supportive and comfortable fabrics which can accommodate a wide variety of surface textures and fiber densities.

It is still a further object of the present invention to provide a method of forming composite elastomeric yarns which are suitable for use in vehicle seat fabrics.

It is yet a further object of the present invention to provide a method of forming a composite elastomeric fabric which is suitable for use in vehicle seats.

SUMMARY OF THE INVENTION

The present invention relates to composite elastomeric yarns and fabrics, to methods of making same, and to articles in which such yarns and fabrics are used. The composite yarns of the present invention comprise a elastomeric core, an elastomeric thermoplastic sheath disposed about the core. The composite yarns also preferably include fibers mechanically anchored in the sheath. An important aspect of certain embodiments of the present invention is the requirement that the polymeric core is a thermoplastic polymeric core and that the melting point temperature of the material comprising the sheath is at least about 10° C., and preferably from about 50° C. to about 75° C., lower than the melting point temperature of the material comprising the core.

The fabrics of the present invention comprise the composite yarns of the present invention, preferably in combination with conventional yarns or fibers, arranged to form a composite fabric. The composite fabric of the present invention may be in any of a variety of forms well known in the art including woven, knit, braided or felted. Preferably, the composite fabric will be a woven pile fabric in which the ground warp and the filling yarn comprise composite yarns and the pile, whether a warp or a filling pile, comprises conventional yarns or fibers. An important aspect of the composite fabrics of the present invention is that the conventional yarns or fibers are not only arranged together with the composite yarns but are also mechanically anchored in the composite yarns. As used herein, the term "conventional yarns or fibers" means yarns or fibers which provide the fabric with the desired texture and/or aesthetic qualities, and is invented to include not only fibers and yarns known and used for this purpose, but also fibers and yarns of the present invention adopted for this purpose.

The method of forming the composite yarns comprises the steps of: providing a composite elastomeric yarn comprising an elastomeric core and an elastomeric thermoplastic sheath disposed about the core wherein the melting point temperature of the sheath is at least about 10° C. lower than the melting point temperature of the core; heating the composite elastomeric yarn to a temperature at or above about the melting point temperature of the sheath but below the melting point temperature of the core; disposing fibers in intimate mechanical contact with the sheath; and cooling the composite elastomeric yarn to mechanically anchor said fibers in said sheath. In certain preferred embodiments, the methods further comprise stretching the composite elastomeric yarn from about 10% to about 500% beyond the relaxed state prior to the step of disposing said fibers. This preferred method enhances the ability of the manufacturer to vary the fiber density and/or bulk of the resulting composite yarn.

The method of forming the composite fabrics comprises the steps of: forming a fabric of conventional yarns or fibers and composite yarns comprising an elastomeric core and an elastomeric thermoplastic sheath disposed about the core wherein the melting point temperature of the sheath is at least about 10° C. lower than the melting point temperature of the core and; heating the composite fabric to a temperature at or above about the melting point temperature of the sheath but below the melting point temperature of the core; and cooling the composite fabric to mechanically anchor said conventional yarns or fibers in said composite yarns.

The articles of the present invention relate to furniture fabrics, and particularly to seating fabrics, comprising composite elastomeric yarns and composite fabrics for use in seats and backs of chairs, benches and sofas used in office and/or residential environments or installed in various forms of ground transportation such as automobiles, motorcycles, trucks, buses, trains, etc., as well as various aircraft and marine craft. By using fabrics comprising the composite elastomeric yarns in vehicle seating assemblies, and preferably the composite fabrics of the present invention, a fabric possessing strength, comfort, breathability and elasticity can be achieved in combination with superior aesthetic qualities. Thin profile vehicle seating assemblies can thus be constructed with fabrics comprising the composite elastomeric yarns, and preferably the composite fabrics of the present invention, without the need for bulky foam cushions, stuffing material, springs or rubber straps while maintaining a desirable combination of support, comfort and appearance.

DETAILED DESCRIPTION OF THE INVENTION

The Composite Yarns

As disclosed herein, the preferred composite yarns of the present invention have improved properties both in high elongation/low modulus embodiments as well as low elongation/high modulus embodiments. More specifically, the composite yarns of the present invention provide an aesthetically pleasing outer surface in both elongated and relaxed form, improved adherence of surface fibers to the elastomeric core, and improved abrasion resistance. Further, the preferred composite yarns of the present invention are able to lock in and hide electro-conductive yarns in the interior thereof as well as cover flammable elastomers with non-flammable or fire resistant fibers to produce elastic yarns which minimize or eliminate burn or the propagation of flame spread.

From an aesthetic perspective, composite yarns of the present invention can be produced with varying degrees of bulk and a wide variety of moduli depending on, at least in part, the desired application, and can be brushed in yarn or fabric form resulting in minimal fiber loss as the surface fibers are mechanically anchored into the body of the yarn. When used in fabrics for vehicle seats in automotive, air and marine craft applications, the combination of properties of the yarns of the present invention provides the necessary support, comfort and appearance previously achieved by means of the combination of foam cushioning, stuffing material, springs, elastic straps and the like.

Figure 1:
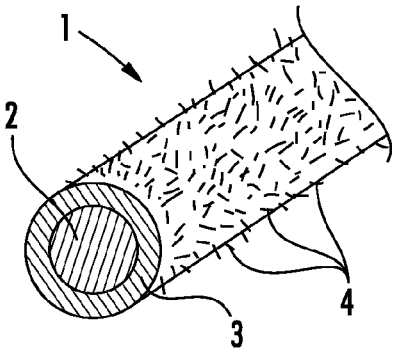
FIG. 1 is a partially cross-sectional, partially angled view of a composite elastomeric yarn according to a first embodiment of the present invention having a monofilament core.
Figure 2:
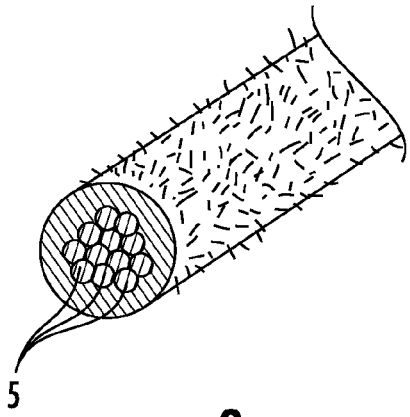
FIG. 2 is partially cross-sectional, partially angled view of a composite elastomeric yarn according to a second embodiment of the present invention having a multifilament core.

The composite yarns of the present invention preferably comprise an elastomeric core, a elastomeric thermoplastic sheath disposed about the core, and fibers disposed about and mechanically anchored in the sheath. FIG. 1 shows generally a segment of a preferred composite yarn of the present invention 1. As further shown in FIG. 1, the yarns comprise a core 2, a sheath 3, and fibers 4 disposed about and mechanically anchored into the sheath. Although the anchored fibers are illustrated in the figures as short, individual strands of fibers, it should be appreciated that in certain embodiments the fiber component may be part of or incorporated into a yarn disposed about the sheath. In certain embodiments, the core comprises a elastomeric monofilament as shown in FIG. 1, while in other embodiments, as shown in FIG. 2, the core comprises a plurality of elastomeric filaments 5 which can be configured in a number of alternative forms well known to the art (i.e., bundled, twisted, braided, etc.).

The material comprising the core, whether a monofilament or multifilament, preferably comprises a polymer which exhibits a relatively high melting point temperature. It is preferred that the melting point temperature of the material comprising the core be in the range of from about 185° C. to about 240° C., and preferably from about 200° C. to about 230° C. By comparison, the material comprising the sheath component preferably comprises a polymer which exhibits a melting point temperature at least 10° C. lower, preferably from about 50° C. to about 75° C., lower than the melting point temperature of the core material. It is preferred that the melting point temperature of the material comprising the sheath be in the range of from about 100° C. to about 200° C., and preferably from about 160° C. to about 190° C.

Provided that the relative melting points of the core material and the sheath material differ by at least about 10° C., the materials comprising the core and the sheath can be selected from a wide variety of readily available polymers which exhibit thermoplastic properties. It is preferred, however, that the materials comprising the core and the sheath be selected so that the melting point temperature differential between them be from up to about 50° C. to up to about 75° C. to allow for greater flexibility in subsequent manufacturing processes. By using materials having different melting points, the sheath component can be heated to a temperature which results in at least the softening and/or tackifying of the sheath material while the core component remains in substantially solid and oriented form.

For high modulus/low elongation yarns, the hardness of the core component of the present invention, as measured on the Shore D hardness scale, is preferably from about 38 to about 82, more preferably from about 45 to about 74, and even more preferably from about 55 to about 74. Although it is contemplated that numerous polymers may be used as the core component of the present invention, polymers which exhibit elastomeric properties are preferred, with elastomeric polyesters being especially preferred. It will be appreciated by those skilled in the art that the term "polyester" as used herein is intended to include polymers which include polyester components, such as co-polymers of polyesters and other polymeric components, including graft and block co-polymers.

In certain preferred embodiments, the core component comprises a polyether ester or a polyester ester, more preferably a polyether ester block copolymer sold under the trademark HYTREL® by E.I. Du Pont de Nemours & Co., Inc. or a polyether ester block copolymer sold under the trademark ARNITEL® by D.S.M. Polymers, and even more preferably HYTREL® grades 5556, 6356 or 7246, or ARNITEL® grades EM 550, EM 630 and EM 740. According to preferred embodiments, the sheath component consists essentially of a polyether ester or a polyester ester, and more preferably a polyether ester block copolymer sold under the trademark HYTREL® by E.I. Du Pont de Nemours & Co., Inc. or a polyether ester block copolymer sold under the trademark ARNITEL® by D.S.M. Polymers, and even more preferably HYTREL® 4056 or ARNITEL® EM 400.

The percent elongation of the core at the breaking point is preferably from about 50% to about 150% beyond its relaxed state, more preferably from about 80% to about 130% beyond its relaxed state, and even more preferably from about 100% to about 110% beyond its relaxed state. The denier range of the core component of the composite yarn is preferably from about 500 to about 2500 and even more preferably from about 800 to about 2000.

The material comprising the sheath component of the composite yarn of the present invention is preferably compatible with the material comprising the core component in order to establish appropriate bonding to and adherence with the core component. The hardness of the sheath component of the composite yarn, as measured on the Shore D hardness scale, is preferably from about 30 to about 45, and even more preferably from about 35 to about 45.

According to preferred embodiments, the composite yarn preferably comprises a core having a hardness of about 55 to about 74 on the Shore D hardness scale and comprising a poly ether ester block copolymer, and a sheath of a softer, lower melting point polyether ester block copolymer having a hardness of about 35 to about 45 on the Shore D hardness scale.

In certain preferred embodiments, additives can be included in the polymeric material used to form the sheath and core components in order to enhance various processing properties thereof including lowering the melting points and/or increasing the melt flow properties, as well as the resultant fabric properties such as toughness, durability, lightfastness, and flammability. The selection of such additives will depend, at least in part, on the requirements of the application to which the fabric will be put. Such additives include, but are not limited to, hydrolytic stabilizers, UV light stabilizers, heat stabilizers, color additives and fixing agents, flame retardants, as well as electrically conductive materials for dissipation of static charges.

The fibers which are disposed about the surface of the sheath generally comprise conventional non-elastic materials which are often used in apparel, home furnishings, automotive, aircraft and marine applications, as well as other industrial and medical applications. It will be appreciated by those skilled in the art that the fibers which may be utilized in accordance with the present invention may vary widely depending on the particular characteristics desired for and requirements imposed by the end product. The fibers of the present invention are preferably selected from the group consisting of cotton, carbon, wool, man-made cellulosics (including cellulose acetate and regenerated cellulose), polyamides, polyesters, fluorocarbon polymers, polybenzimidazoles, polyolefins (including polyethylene and polypropylene), polysulfides, polyacrylonitriles, polymetaphenylene isophthalamide, polymetaphenylene diamine manufactured by E.I. Du Pont de Nemours & Co., Inc. under the trademark NOMEX®, polyvinyl acetate, polyvinyl chloride, polyvinylidene chloride and other flaccid textile materials, as well as non-flaccid fibers such as polyparaphenylene terephthalamide manufactured by E.I. Du Pont de Nemours & Co., Inc. under the trademark KEVLAR®, fiberglass, metallic and ultra high strength polyethylenes and high tenacity polyesters, nylons and poly(vinyl alcohols). Suitable fibers for use in the present invention can also be characterized by type, i.e., spun (ring, friction, wrap, etc.), chenille, and filament (flat, false twist, airjet, stuffier box, etc.). It will be understood that as used herein fibers can include both single, individual fibers, such as chopped strands, or fibers which are spun, twisted or otherwise bound together to form a yarn.

The fibers are preferably disposed about the surface of the sheath by means of the various methods set forth below wherein the fibers are anchored in the sheath. So disposed, the fibers are mechanically bonded to the sheath so that the resulting composite yarn exhibits durability and wear resistance while also providing a wide range of textures and fiber densities depending on the fibers used and the particular method of application employed.

The Composite Fabrics

As disclosed herein, the preferred composite fabrics of the present invention, like the preferred composite yarns of the present invention, have improved properties both in high elongation/low modulus embodiments as well as low elongation/high modulus embodiments. More specifically, the composite fabrics of the present invention provide an aesthetically pleasing surface in both elongated and relaxed form as well as improved wear and abrasion resistance. In those embodiments in which the composite fabric is of woven pile construction, the composite fabric also provides improved adherence of the pile fibers to the ground warp and/or filling yarn without having to apply coating compositions or additional layers of fabric or other materials to the backside thereof. Among the advantages which are realized by the avoidance of such additional components in the composite fabric of the present invention are a reduction in thickness and weight, improved elasticity and breathability, and the elimination of additional material, labor and disposal costs.

The composite fabrics of the present invention preferably comprise the composite yarns of the present invention and conventional fibers arranged to form a fabric. Preferably, the composite yarns used in the composite fabrics of the present invention comprise an elastomeric core and a thermoplastic elastomeric sheath disposed about the core wherein the melting point temperature of the sheath is at least about 10° C. lower than the melting point temperature of the core. The conventional fibers suitable for use in the composite fabrics of the present invention are those which a capable of being combined with and anchored in the sheath component of the composite yarns, and include all of the fibers and fiber types recited above in connection with the composite yarns of the present invention.

The formation of a fabric from composite yarns and conventional fibers may be accomplished by any of the methods well known in the art including weaving, knitting, braiding, felting and other such methods. In certain preferred embodiments, the composite fabric will be in the form of a woven pile fabric. In such embodiments, at least some portion of the ground warp yarns, or some portion of the filling yarn, comprise composite yarns, and the pile, either warp or filling, will preferably comprise conventional fibers. According to preferred embodiments, the ground warp yarns or the filling yarns, and even more preferably both yarns, consist essentially of the composite yarn of the present invention. Conventional fibers used in the present invention are preferably spun, twisted, textured or otherwise bound together to some portion of both the ground warp and the filling yarn, and are preferably interlaced with respect to the ground warp or filling yarn in a "V" or "W" configuration wherein segments of the conventional fibers are wrapped around either one ("V") or three ("W") composite yarns of the ground warp and/or filling yarn.

As disposed in the composite fabric as the warp or filling pile, the conventional fibers may or may not then be cut depending on whether a cut pile or a loop pile is desired for the end use application. Regardless of whether in the form of a cut or loop pile, or indeed in the form of a woven pile, an important aspect of the composite fabrics of the present invention is that the conventional yarns or fibers are not only arranged in the fabric with the composite yarns in accordance with the selected method of construction but are also mechanically anchored in the composite yarns.

The Methods

The methods of the present invention relate to the formation of composite elastomeric yarns and composite fabric.

A. The Composite Yarns

With respect to the formation of composite elastomeric yarns, the methods preferably comprise the steps of: providing a sheath-core component comprising an elastomeric core and a thermoplastic elastomeric sheath disposed about the core wherein the melting point temperature of the sheath is at least about 10° C. lower than the melting point temperature of the core; heating the sheath-core component to a temperature above the melting point of the sheath but below the melting point of the core; disposing fibers in intimate mechanical contact about the sheath; and cooling the composite elastomeric yarn thus formed to mechanically anchor the fibers to the sheath.

The above description in which the heating step is described prior to the cooling step should not be understood as limiting the sequence of the steps used according to the present invention. According certain preferred embodiments, for example, the step of disposing the fibers in intimate contact with the sheath occurs prior to heating of the sheath-component. In certain other preferred embodiments, the step of disposing the fibers in intimate contact with the sheath occurs subsequent to heating of the sheath-component. In certain preferred embodiments, as shown in the sequence of FIG. 3 to FIG. 5, the sheath-core component will be stretched from about 10% to about 500% beyond its relaxed length prior to the disposition of fibers about the sheath.

The initial step of providing the sheath-core component can be accomplished in a variety of ways including forming the sheath-core component by methods well known to the art or obtaining certain pre-made sheath-core components from other sources. The methods of forming the sheath-core component include the pulltrusion technique of forming the core component and then drawing the core component through a molten bath of the sheath material at a temperature above that of the melting point temperature of the sheath material but below that of the melting point temperature of the core material. Alternatively, the core component can be simultaneously co-extruded with the sheath component at a temperature appropriate for such simultaneous co-extrusion in a manner such that the extrudate comprises a core comprising the higher melting point material and a sheath comprising the lower melting point material as disclosed by Himmelreich, Jr. (U.S. Pat. No. 4,469,738) which is incorporated herein by reference. Another alternative for providing a sheath-core component according to the present invention is a crosshead technique in which the core is preformed and is fed through the center of a crosshead extrusion die wherein the sheath material is extruded as an outer jacket or covering over the preformed core material. It will be understood that certain embodiments of the methods of the present invention will employ a monofilament core, while in other embodiments of the methods of the present invention the core comprises a plurality of filaments.

Another step in the methods of the present invention comprises heating the sheath-core component to a temperature above that of the melting point temperature of the sheath material but below that of the melting point temperature of the core material. In so doing, the sheath material is softened or at least tackified to permit mechanical bonding with the fibers which may be subsequently applied or which may have already been applied. In certain preferred embodiments, the heating step will occur during manufacture of the composite yarn but prior to its incorporation into a fabric. In other embodiments, however, the partially-formed yarn of the present invention, that is, the sheath-core component, is first incorporated into a fabric manufacturing process so that the resulting fabric comprising strands of the sheath-core component of the present invention will be the article that is heated.

Figure 3:
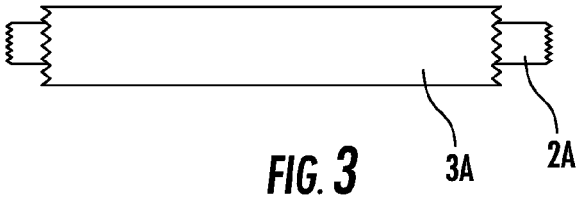
FIG. 3 is the first view in a sequence of three profile views showing a segment of the composite yarn prior to the disposition of fibers on the surface of the sheath.
Figure 4:
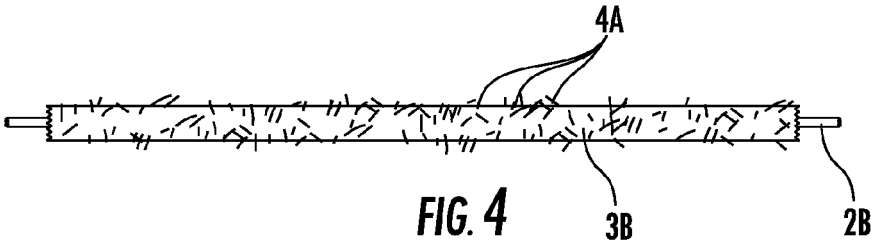
FIG. 4 is the second view in a sequence of three profile views showing the disposition of fibers on the surface of the sheath of the segment of FIG. 3 after the composite yarn has been stretched.
Figure 5:
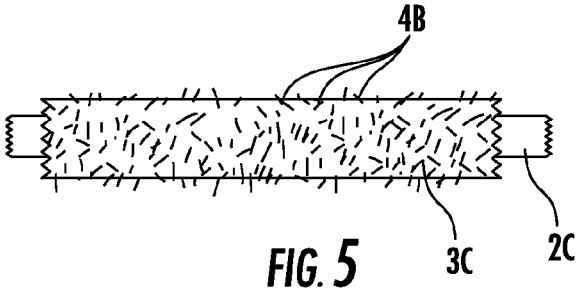
FIG. 5 is the third view in a sequence of three profile views showing the segment of FIG. 3 after the composite yarn has been relaxed from a stretched state in which fibers have been disposed on and anchored in the surface of the sheath.
Figure 6:
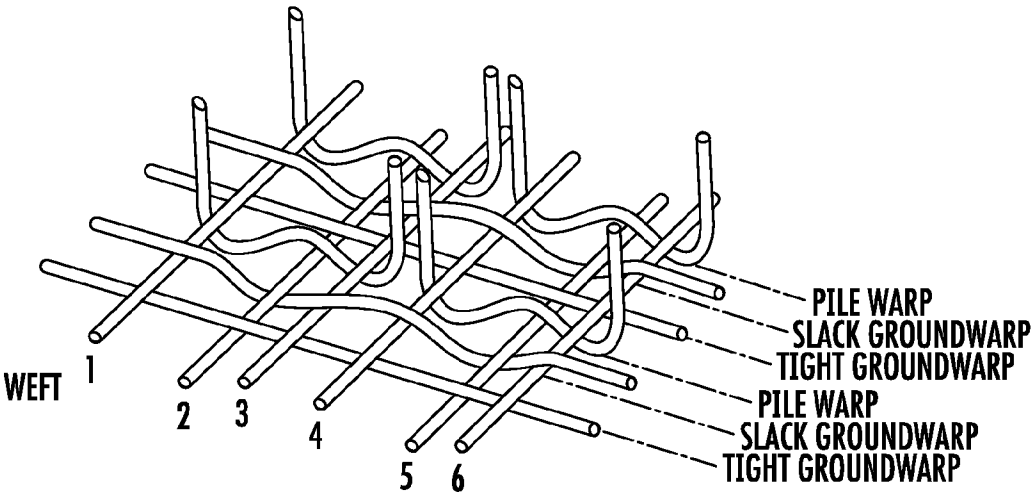
FIG. 6 is a schematic view of an embodiment of a "W" configuration woven pile weave pattern which may be employed in the formation of the composite fabric of the present invention.
Figure 7:
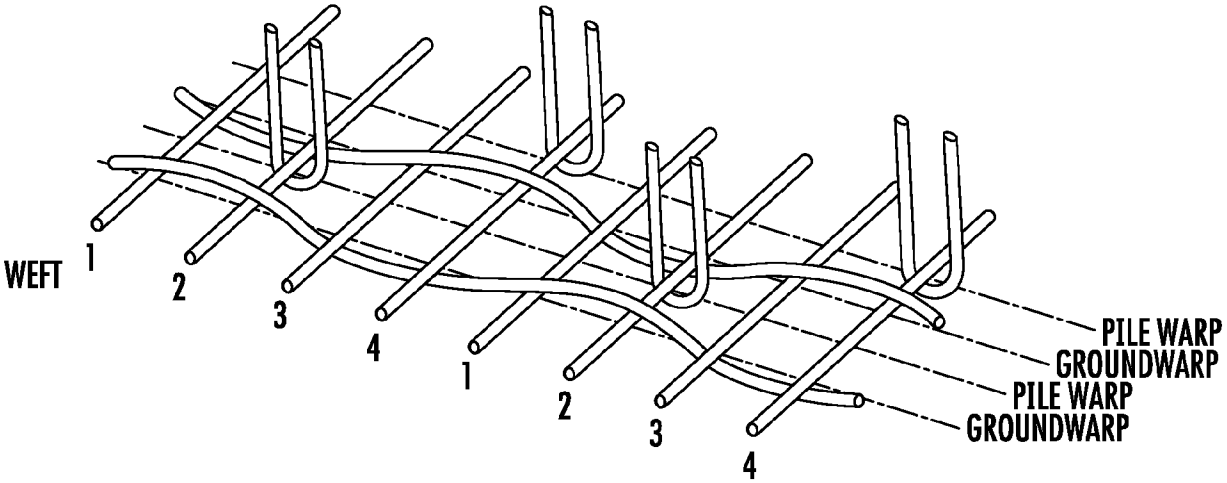
FIG. 7 is a schematic view of an embodiment of a "V" configuration woven pile weave pattern which may be employed in the formation of the composite fabric of the present invention.
Figure 8:
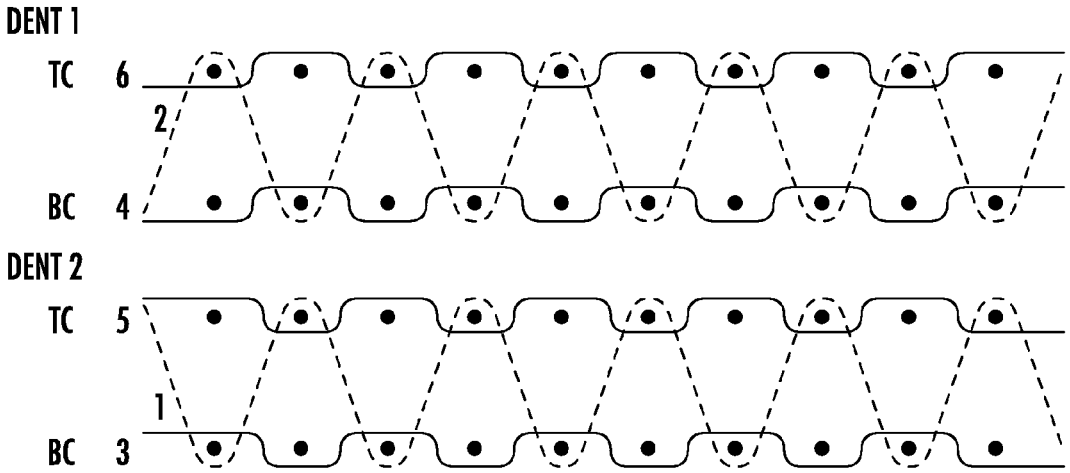
FIGS. 8 through 13 are schematic views of alternative woven pile weave patterns which may be employed in the formation of the composite fabric of the present invention wherein the two rows of dots represent profile views of filling yarns, the parallel sinusoidal lines about each row of dots represents ground warps, and the sinusoidal lines alternating between rows of dots represents warp pile.
Figure 9:
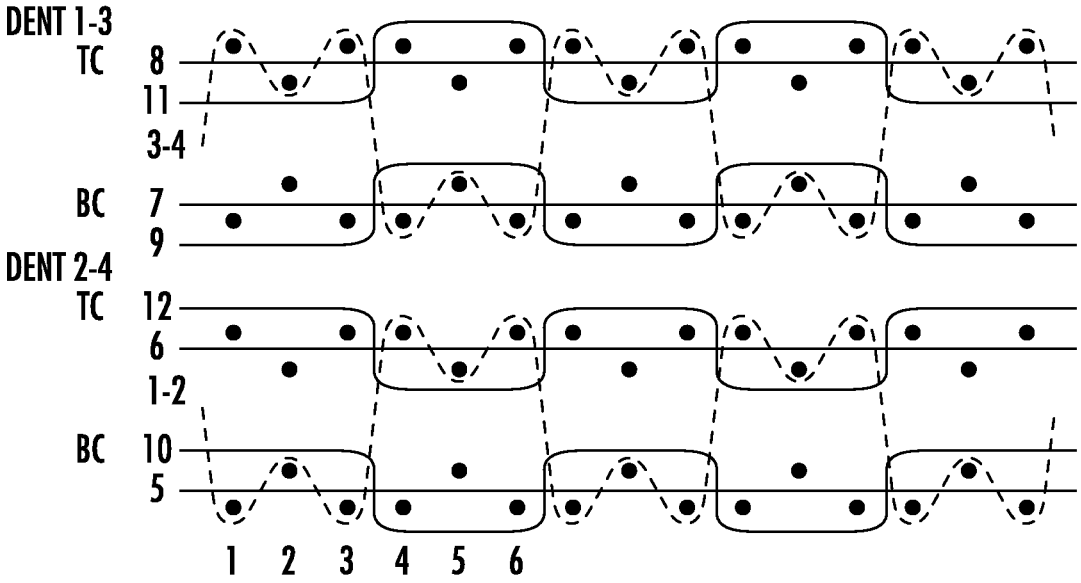
Figure 10:
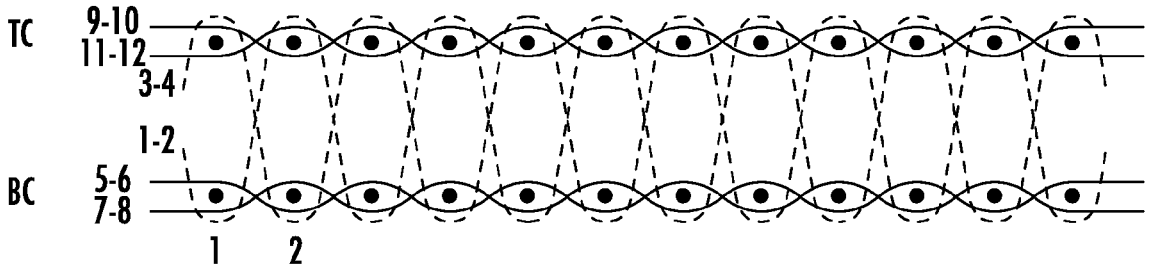
Figure 11:
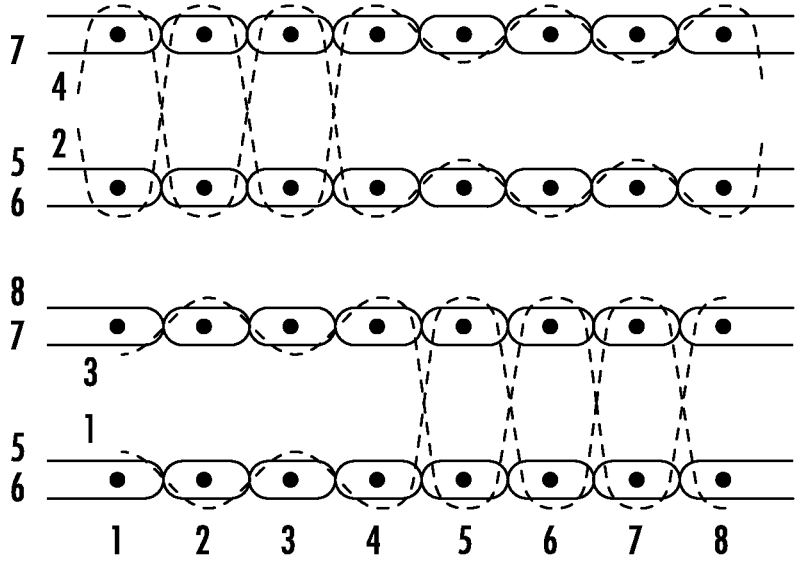
Figure 12:
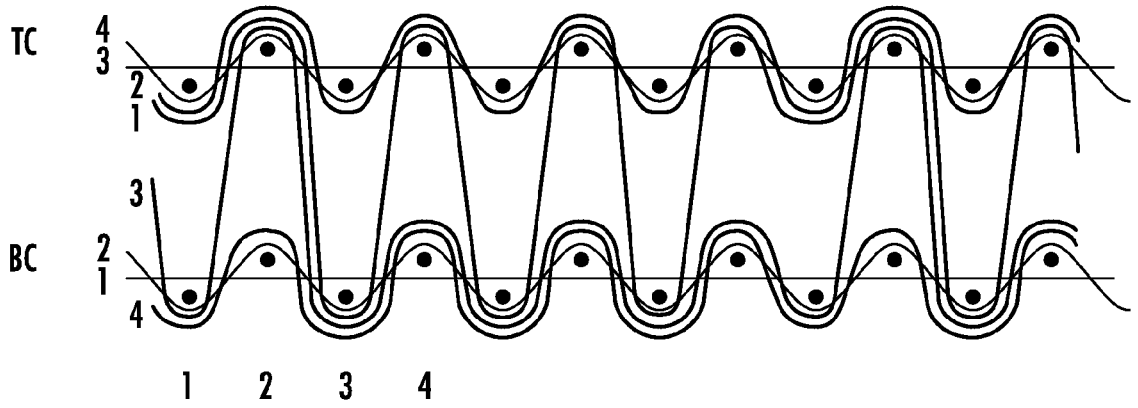
Figure 13:
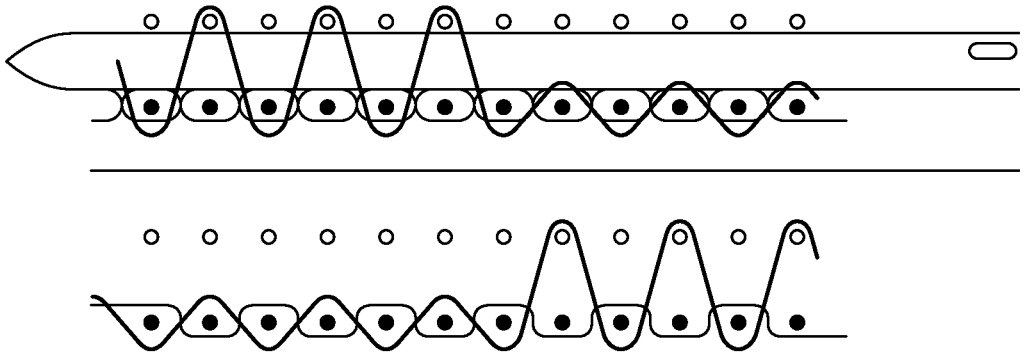

In certain preferred embodiments, the sheath-core component is stretched beyond its relaxed state but within its elastic range prior to the application of fibers as shown in the sequence of FIG. 3 to FIG. 5. Such stretching allows the resulting composite yarn to take on varying degrees of bulk and/or density. More specifically, FIG. 3 shows a segment of the sheath-core component comprising a core 2A and sheath 3A prior to stretching. FIG. 4 shows the subsequent view of the segment shown in FIG. 3 in which the segment of the sheath-core component has been stretched and fibers 4A have been disposed about the surface of sheath 3B. Sheath 3B and core 2B are shown having a thinner profile as a result of the stretched state depicted in FIG. 4. FIG. 5 shows a view subsequent to the view shown in FIG. 4 in which core 2C and sheath 3C have returned to their original relaxed, i.e. unstretched, state, and fibers 4B exhibit a greater density than fibers 4A exhibit in FIG. 4. As shown by the sequence of FIGS. 3 to 5, when the sheath-core component is stretched, any given interval of the sheath-core component in the relaxed form presents a greater surface area in stretched form on which to accommodate the application of fibers. Thus, when the sheath-core component is then relaxed to an unstretched state, the density of fibers within any given interval is greater than if such fibers were applied without stretching. As a result, the greater degree to which the sheath-core component is stretched within its elastic range prior to the application of fibers, the greater the bulk and fiber density of the resulting composite fiber.

In certain preferred embodiments, the methods of the present invention further comprise the step of stretching the sheath-core component from about 10% to about 500% beyond its relaxed length prior to the application of fibers. The optimal degree of stretching will depend upon the materials used in forming the sheath-core component as well as the intended end use of the composite yarn. By way of example, for high modulus thermoplastic polyether-ester block copolymer elastomers such as HYTREL®, the degree of stretching beyond its relaxed length would be from about 10% to about 40%, and preferably from about 12% to about 18%. For lower modulus elastomers such as LYCRA® spandex manufactured by E.I. Du Pont de Nemours & Co., Inc., the degree of stretching would typically be from about 300% to about 500%, and preferably from about 350% to about 425%. In certain preferred embodiments, by stretching the sheath-core component prior to application of the fibers, the resulting composite yarn when used in fabric manufacturing processes (i.e., weaving, knitting, etc.) will be capable of stretching and recovering freely without significant restrictions imposed by fibers anchored at more than one site in the composite yarn surface. It will be understood that, depending on the desired manufacturing process and end use, for those embodiments in which a stretching step is a part, the stretching step can occur when the sheath-core component is in yarn form or when it has already been processed or partially processed into a fabric.

Another step in the methods of the present invention comprises disposing fibers in intimate mechanical contact about the sheath-core component. As stated above, in certain preferred embodiments, the disposition of fibers will occur while the sheath-core component is in yarn form. In other embodiments, however, the sheath-core component will have already been used in a fabric manufacturing process so that the application of fibers will be upon the surface or surfaces of the fabric. It will be understood that the fibers disposed about the sheath-core component can be in the form of free fibers or in the form of yarn or a combination thereof. Depending on the fibers to be applied, the desired bulkiness, and the desired end use, the form of the fibers so disposed will vary and the process by which the fibers may be disposed includes wrapping, spinning, twisting, flocking, or any number of other procedures well known to the art provided, however, that by so disposing the fibers about the sheath-core component said fibers are able to penetrate into at least a portion of the sheath component so as to achieve a mechanical bond thereto.

The heating step for locking the exterior textile fibers to the sheath component way occur either prior or subsequent to the disposition of fibers about the sheath-core component. In certain preferred embodiments, the heating step takes place directly after the disposition of the fibers around the sheath-core component while the sheath-core component is in yarn form. In certain other preferred embodiments, the heating step takes place while the sheath-core component is in fabric form.

The final step in the methods of forming the composite yarn of the present invention comprises cooling the composite yarn so as to effect the anchoring of the fibers in the sheath component.

B. The Composite Fabric

Figure 14:
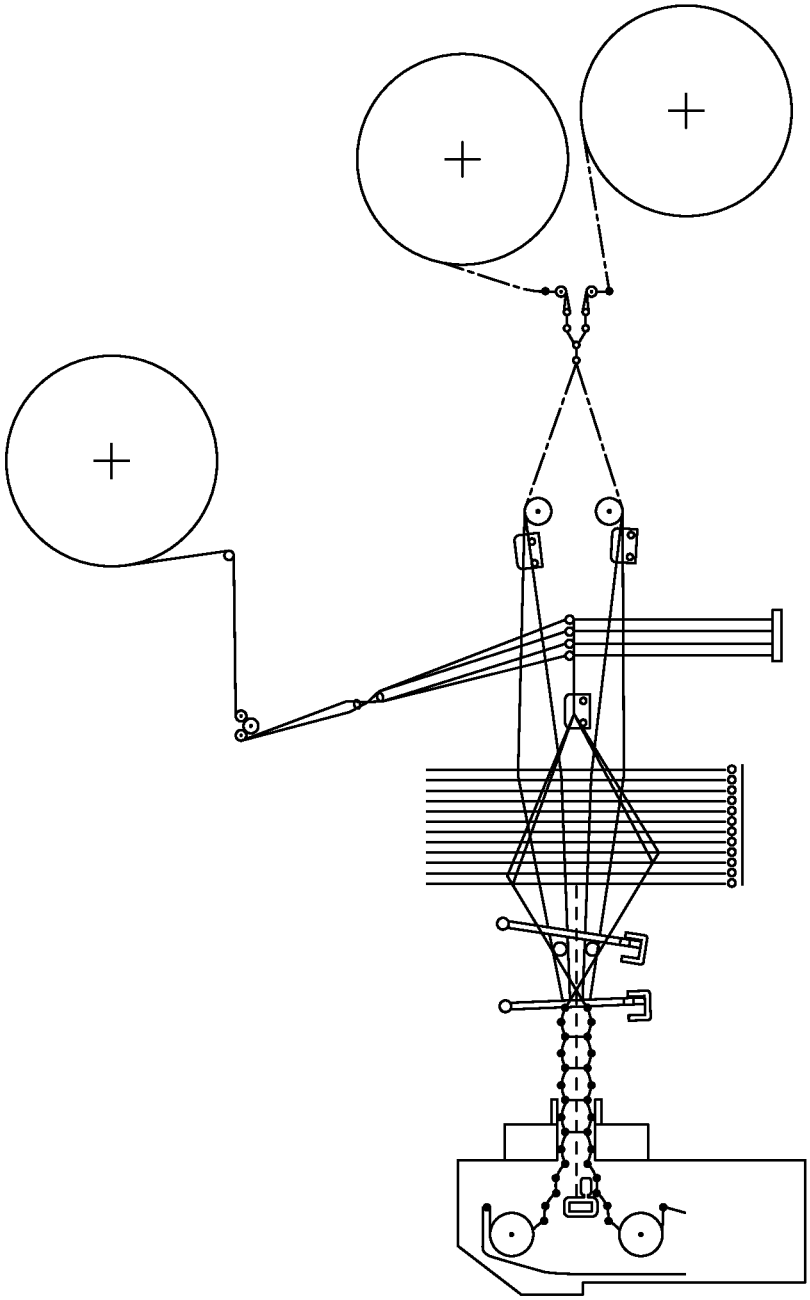
FIG. 14 is a schematic view of an embodiment of a loom configuration for making a woven fabric.

With respect to the formation of composite fabric, the methods preferably comprise the steps of: forming a fabric of conventional yarns or fibers and composite yarns comprising an elastomeric core and an elastomeric thermoplastic sheath disposed about the core wherein the melting point temperature of the sheath is at least about 10° C., preferably about 50° C. to about 75° C., lower than the melting point temperature of the core and; heating the composite fabric to a temperature at or above about the melting point temperature of the sheath but below the melting point temperature of the core; and cooling the composite fabric to mechanically anchor said conventional yarns or fibers in said composite yarns. The initial step of forming a fabric of conventional yarns or fibers and composite yarns can be accomplished in a variety of methods well known to the art. These methods include, but are not limited to, weaving, knitting, braiding or felting. An schematic illustrating one weaving method for making a woven pile fabric is shown generally in FIG. 14. Preferably, the step of forming a fabric will be by means of weaving and, more preferably, by means of pile weaving whereby a ground warp and filling yarn comprising the composite yarns of the present invention are interlaced with a warp or filling pile of conventional fibers. In such embodiments, the warp or filling pile may be interlaced with respect to the ground warp or filling yarns in any of a variety of configurations known to the art. Preferably, the warp or filling pile will be interlaced in a "V" or "W" configuration wherein segments of the warp or filling pile are wrapped around either one ("V") or three ("W") composite yarns of the ground warp or filling yarns. Various embodiments of such weaving patterns are shown in FIGS. 6 through 13.

Another step in the methods of the present invention comprises heating the composite fabric to a temperature above that of the melting point temperature of the sheath material of the composite yarns but below that of the melting point temperature of the core material thereof. In so doing, the sheath material is softened or at least tackified to permit mechanical bonding with the conventional fibers interlaced therewith. While the selection of the temperature to which the composite fabric is heated is determined, at least in part, by the selection of materials comprising the composite yarns, consideration must also be given to the limitations imposed by the fiber materials selected so that such materials are not degraded during the heating step.

The final step in the methods of forming the composite fabric of the present invention comprises cooling the composite fabric so as to effect the anchoring of the fibers in the sheath component of the composite yarns.

The Articles

The resulting composite elastomeric yarns and composite fabrics of the present invention can be used in manufacturing processes for the formation of fabric articles having a desirable combination of properties well suited for use in vehicle seats in automotive, air and marine craft applications as well as in commercial and residential furniture for use in indoor and outdoor settings. Because of the superior elasticity, durability and wear resistance of fabrics made from composite elastomeric yarns of the present invention, and particularly the composite fabrics of the present invention, as well as the wide range of textures and fiber densities which can be achieved, vehicle seats for use in automotive, air and marine craft applications, as well as commercial and residential furniture, can be constructed without the need for the additional use of foam cushioning, stuffing material, springs, elastic straps or combinations thereof. Such thin profile vehicle seats as described in Abu-Isa, et al. (U.S. Pat. No. 5,013,089), Abu-Isa, et al. (U.S. Pat. No. 4,869,554) and Abu-Isa, et al. (U.S. Pat. No. 4,545,614) all of which are incorporated herein by reference, are examples of preferred articles which can be constructed from fabrics comprising composite elastomeric yarns of the present invention as well as the composite fabrics of the present invention. More particularly, such articles include a seat assembly, having a seat frame and a low profile seat suspension stretched across and attached to the frame. The seat suspension of such seat assembly comprises a fabric comprising the composite yarns or the composite fabric of the present invention.

I claim:

1. An arrangement of fibers and composite elastomeric yarns comprising:

(a) fibers; and (b) composite elastomeric yarns comprising an elastomeric core component and an elastomeric thermoplastic sheath component disposed about the core component wherein a melting point temperature of the sheath component is at least about 10° C. lower than a melting point temperature of the core component, wherein the fibers are disposed about the sheath component of the composite elastomeric yarns by spinning or twisting and at least a portion of the fibers are anchored in at least a portion of the sheath component of the composite elastomeric yarns.

2. The arrangement of claim 1 wherein the melting point temperature of the sheath component is at least about 50° C. to about 75° C. lower than the melting point temperature of the core component.

3. The arrangement of claim 1 wherein the fibers are non-elastic fibers.

4. The arrangement of claim 1 wherein the elastomeric core component comprises an elastomeric monofilament.

5. The arrangement of claim 1 wherein the elastomeric core component comprises a plurality of elastomeric filaments.

6. The arrangement of claim 1 wherein the elastomeric core component comprises a denier range from about 500 to about 2500.

7. The arrangement of claim 1 wherein the elastomeric core component comprises a Shore D hardness of about 55 to about 82 and the elastomeric sheath component comprises a Shore D hardness of about 35 to about 45.

8. A composite fabric comprising:

an arrangement of fibers and composite elastomeric yarns, the arrangement comprising:

(a) fibers; and (b) composite elastomeric yarns comprising an elastomeric core component and an elastomeric thermoplastic sheath component disposed about the core component wherein a melting point temperature of the sheath component is at least about 10° C. lower than a melting point temperature of the core component, wherein the fibers are disposed about the sheath component of the composite elastomeric yarns by spinning or twisting and at least a portion of the fibers are anchored in at least a portion of the sheath component of the composite elastomeric yarns, wherein the arrangement of composite elastomeric yarns and fibers are woven, knitted, braided or felted together to form the composite fabric.

9. The composite fabric of claim 8, wherein the composite fabric is elastomeric.

* * * * *